United States Patent [19]

Tengstrand et al.

[11] Patent Number: 4,878,561

[45] Date of Patent: Nov. 7, 1989

[54] SOUND EMITTER

[75] Inventors: Göran Tengstrand, Hägersten; Boris Lindblom; Jerry Nilsson, both of Tyresö ; Peter Lundén, Stockholm, all of Sweden

[73] Assignee: Satt Communications AB, Stockholm, Sweden

[21] Appl. No.: 213,583

[22] PCT Filed: Dec. 12, 1986

[86] PCT No.: PCT/SE86/00571

§ 371 Date: Jun. 23, 1988

§ 102(e) Date: Jun. 23, 1988

[87] PCT Pub. No.: WO87/03994

PCT Pub. Date: Jul. 2, 1987

[30] Foreign Application Priority Data

Dec. 23, 1985 [SE] Sweden ..... 8506106-7

[51] Int. Cl.[4] ..... G10K 11/10

[52] U.S. Cl. ..... 181/188; 181/144; 181/190; 181/191; 181/192; 381/156; 381/160

[58] Field of Search ..... 181/144–147, 181/187, 188, 189, 190, 191, 195, 155, 192; 381/156, 160, 152, 158

[56] References Cited

U.S. PATENT DOCUMENTS

| | | | |
|---|---|---|---|
| 2,297,972 | 10/1942 | Wills | 381/152 |
| 2,550,359 | 4/1951 | Levy | 181/187 |
| 2,832,843 | 4/1958 | Wiessner | 381/158 |
| 2,969,848 | 1/1961 | Farwell | 181/145 |
| 3,477,540 | 11/1969 | Rizo-Patton | 181/144 X |
| 3,842,203 | 10/1974 | Weisberg | 381/156 |

*Primary Examiner*—B. R. Fuller

*Attorney, Agent, or Firm*—Brooks & Kushman

[57] ABSTRACT

An omnidirectional sound emitter with separate sound sources (1, 2), each comprising a funnel-shaped horn (4), is characterized in that the sound sources (1, 2) are mutually arranged such that the acoustic main axes (6) of the horns (4) lie in essentially one and the same plane (7) and the sound-emitting open ends (8) of the horns are directed towards the central portion of the sound emitter and located at a distance ($B_S$; $B_D$) from one another. Slot-shaped openings (9) are so arranged between the open ends (8) of adjacent horns (4) that sound emitted by the horns is caused to pass in a direction from the sound emitter through the slot-shaped openings (9), thereby to be dispersed through 360° in the said plane (7) such that the sound representation from the sound emitter corresponds to the sound representation from a line source perpendicular to said plane (7).

9 Claims, 2 Drawing Sheets

SOUND EMITTER

The present invention relates to an omnidirectional sound emitter with separate sources of sound, each comprising a funnel-shaped horn. More particularly, the invention relates to a sound emitter which is adapted to emit acoustic energy through 360° in a predetermined plane, for example the horizontal plane, without producing any appreciable acoustic effect in directions perpendicular to said first plane, for example straight up and straight down, said horns having their respective sound-emitting end openings directed toward the central portion of the sound emitter and mounted in spaced-apart relationship.

Sound emitters of the above-mentioned type may be used for generating for example acoustic alarm signals, such as an air-raid alarm and the like, where it is desired to produce a sound field which is symmetrical through 360° about the emitter in the horizontal plane within the desired frequency range, and at the same time to restrict as much as possible the emitted acoustic loss upwards and downwards.

To make the emitter satisfy these desiderata, i.e. to emit acoustic energy within a lobe restricted in the vertical plane, certain demands are made on the emitter, and so far these demands could not be adequately met.

Theoretically, an infinitesimal point source of sound gives a spherically symmetrical sound representation, and a linear sound source of infinitesimal or negligible thickness gives a sound representation which is symmetrical with respect to the longitudinal axis of the sound source. Increasing dimensions of the sound source give a more or less directed radiation, a directional effect which is mainly dependent on the wavelength of the sound in relation to the sound-emitting opening of the sound source. More particularly, the sound-emitting opening must be small in relation to the wavelength concerned, if the undesired directional effect is to be avoided.

This entails special problems in connection with sound sources equipped with horns. In order to achieve adequate acoustic adaptation of the sound emitting part of the sound source to the surrounding medium, a horn is required which has a comparatively large opening area in relation to the wavelength and a length suitable for the frequencies concerned. For the frequencies used in the generation of alarm signals, such horns in particular will obtain relatively large outer dimensions, something that is, according to the theory, a cause of considerable difficulties with respect to the directional effect of the sound at certain frequencies.

It is already known within the art to arrange the sources of light in a sound emitter of the type mentioned by way of introduction in such a manner that the open ends of the horns are directed away from one another to emit sound in a direction away from the centre of the sound emitter. Such arrangements are disclosed in, for example, Swedish patent specification 79013 and the Swedish registered designs 34,314 and 34,315. These arrangements which, as a consequence of their relatively large dimensions at the sound-emitting openings of the horns, suffer from the above-mentioned directional problem, also exhibit the phenomenon that the sound from one side of the emitter may obliterate the sound from the other side of the emitter by interference.

Omnidirectional sound emitters are, furthermore, previously known from the Swedish registered designs 32,215, 32,216 and 32,217. These emitters comprise saucer-shaped horns coaxially mounted with their concave surfaces facing one another and with their peripheral edges in spaced-apart relationship, such that an annular sound gap is formed between the horns. Theoretically, the sound representation from such a sound emitter may be resembled to the sound representation from a filamentary circular sound source of non-negligible diameter. Because of this non-negligible diameter, the sound representation of the emitter will obtain theoretically, and also in actual practice, zero or nodal points in a plane coinciding with the circle at certain frequencies which lie in mutually identical frequency ranges and whose values are dependent on the diameter of the sound emitter or the circle.

Other prior art omnidirectional sound emitters of the above-mentioned type, i.e. with oppositely directed horns whose peripheral edges form a cylindrical annular sound exit opening, are disclosed in, for example, GB No. 375,994, U.S. Pat. No. 3,477,540, U.S. Pat. No. 2,969,848 and DE No. 2,701,080.

It should also be mentioned that it is previously known in the field of conical membrane loudspeakers, to arrange two conventional loudspeaker elements coaxially with one another, such that the open circular ends of the membranes are facing one another. Such constructions are shown in, for example, U.S. Pat. Nos. 2,297,972 and 2,832,843. However, these prior art constructions serve to simulate the sound representation from a spherical pulsating membrane, i.e. to produce an omnidirectional sound representation sweeping the entire space, in contrast to the sound emitter according to the invention which gives a sound representation symmetrical through 360° in the horizontal plane within a restricted lobe in the vertical plane. Moreover, these prior art constructions distinguish from the present invention in the essential respect that the sound emitted by the sound emitter is not emitted from a gap or the like between the separate sound sources, but from the oscillating membrane outer faces. These prior art constructions thus comprise no rigid funnel-shaped horns, and as a consequence of the non-negligible dimensions of the loudspeaker elements, these prior art constructions also have an undesired directional effect at certain frequencies.

It therefore is the object of the present invention to provide a sound emitter whose sound representation approximatively corresponds to the sound representation from an infinitesimal or filamentary line source.

This object is achieved in that the sound emitter according to the invention has its sound sources mutually arranged such that the acoustic main axes of the horns lie substantially in one and the same plane, and the sound-emitting open ends of the horns are directed towards the central portion of the sound emitter and arranged at a distance from another, and that slot-shaped openings are so arranged between the open ends of adjacent horns that sound emitted by the horns is caused to pass in a direction from the sound emitter out through the slot-shaped openings, thereby to be dispersed in the said plane.

In order to achieve adequate dispersion of the sound in the said plane which, for example, may be the horizontal plane, the width of the slot-shaped openings preferably is small in relation to the wavelength of the sound emitted.

In its simplest embodiment, the sound emitter comprises two sound sources, each with one horn, said horns having the same rectangular cross-section and being mounted such that a "sound column" is defined between the open ends of the horns, the cross-section of said "sound column", as seen perpendicularly to said plane, being approximately square, with an edge length which is small in relation to the wavelength concerned. This sound column approximates a theoretical filamentary line source, and practical experiments have shown that the sound representation from the sound emitter according to the invention well agrees with the theoretical sound representation from a filamentary line source.

By varying the height of the sound column, i.e. by varying the height of the open ends of the horns, it is possible to vary, in known manner, the lobe angle within which the sound emitter emits acoustic energy in the vertical plane, which means, if the sound emitter is omnidirectional in the horizontal plane, that the emitted effect can be restricted upwards and downwards to the desired extent.

According to another aspect of the invention, a rod-shaped body having a sound-reflecting surface is so arranged in the space between the open ends of the horn and at a distance therefrom that the main part of the sound emitted from the horns is reflected against the sound-reflecting body before it leaves the slot-shaped openings.

This aspect of the invention is especially useful when it is desired to provide a higher acoustic total effect from the sound emitter, and may preferably comprise a larger number of sound sources arranged symmetrically around the reflecting body.

In order to achieve the desired sound representation, the sound sources preferably operate in phase with one another, such that the sound pressure at the horn openings of each sound source is essentially the same at any moment.

These and other characteristic features of the invention will appear from the appended claims.

The invention will now be described in more detail by means of two preferred embodiments, reference being had to the accompanying drawings.

Figure 1:
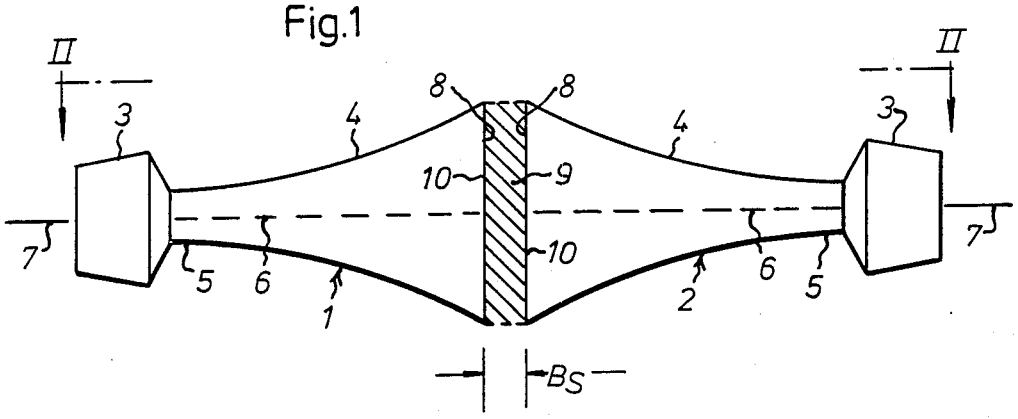
FIG. 1 is a lateral view of a first embodient of the invention.
Figure 2:
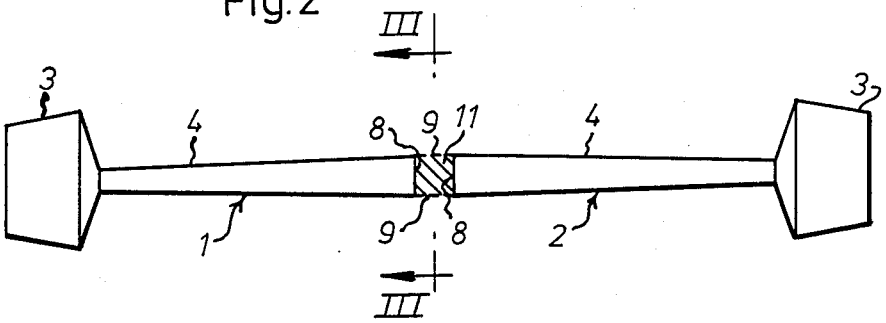
FIG. 2 is a view corresponding to FIG. 1 and seen directly from above along line II—II in FIG. 1.
Figure 3:
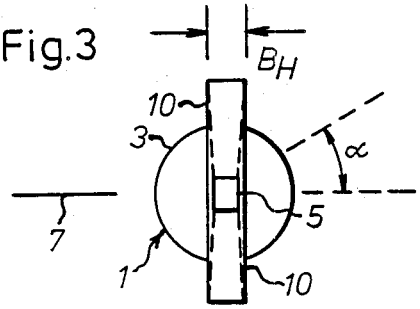
FIG. 3 shows directly from in front a sound source with a horn, as seen along line III—III in FIG. 2.

In FIGS. 1–3, 1 and 2 are two separate sound sources each comprising a sound generating unit 3, such as an electroacoustic converter, and each comprising a funnel-shaped horn 4 for acoustic adaptation of the sound generating unit 3 to the surrounding medium, such as air, the narrow ends 5 of said horns being connected to the sound generating unit 3. In the embodiment illustrated, the sound sources 1 and 2 are arranged coaxially, such that the acoustic main axes 6 of the horns 4 coincide along a common line in the horizontal plane 7.

The open, sound emitting ends 8 of the horns 4 which, as will appear from FIG. 3, are rectangular in cross-section with the longitudinal axis of the rectangle perpendicular to the horizontal plane 7, are located at a distance $B_S$ from one another and so directed that the horns 4, when the sound emitter is operated, emit sound straight at their open ends 8.

By this construction, there are obtained between the open ends 8 of the horns two elongate slot-shaped openings 9 whose vertical longitudinal edges are defined by the peripheral edges 10 of the horn openings 8 perpendicular to the horizontal plane 7.

The hatched area 11 between the horns 4 in FIGS. 1 and 2, which is defined on the one hand by the rectangular openings 8 of the horns 4 and, on the other hand, by the rectangular slot-shaped openings 9, thus forms a vertical "sound column" which, during operation of the sound emitter, emits acoustic energy substantially through the slot-shaped openings 9.

By making the gap width $B_S$ and the width $B_H$ of the horn openings 8 small in relation to the wavelength concerned, a sound column 11 is obtained whose extent perpendicular to its longitudinal axis is small in relation to the wavelengths concerned, i.e. a sound column which has essentially the same characteristics as a theoretical vertical and filamentary line source of negligible thickness.

The omnidirectional effect of the sound emitter according to the invention in the horizontal plane is achieved in known manner by dispersing the sound through the slot-shaped openings 9. By varying the height of the column 11, i.e. by varying the vertical extent of the horn openings 8, it is also possible to determine, in known manner, the directivity of the emitter, i.e. the lobe angle $\alpha$ (FIG. 3) within which the sound emitter is to emit acoustic energy in the vertical plane.

Figure 4:
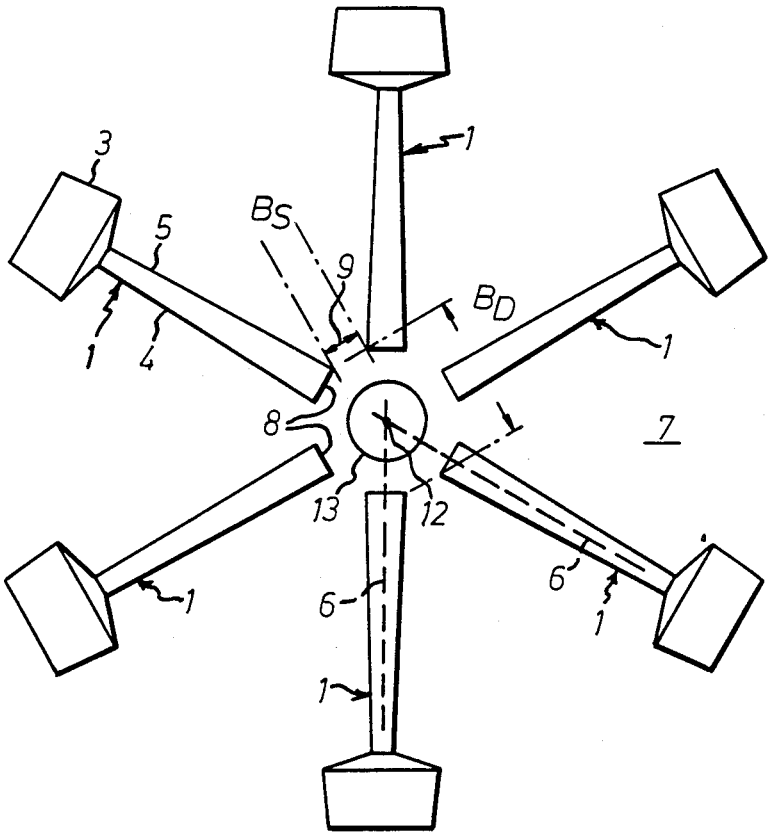
FIG. 4 illustrates directly from above a second embodiment of the invention.

FIG. 4 illustrates a second embodiment of the invention in which like components in FIG. 4 and FIGS. 1–3 are identified by like numerals. The embodiment shown in FIG. 4 comprises six separate sound sources 1 each of which, as in the first embodiment, comprise a sound generating unit 3 and a horn 4 which is connected to said unit and has a rectangular end opening 8. The acoustic main axes 6 of the horns all lie in the horizontal plane 7 and intersect each other at a common point 12. In this variant of the invention, a cylindrical body 3 having a sound-reflecting envelope is arranged in the space between the open ends 8 of the horns and at a distance therefrom, such that the sound emitted by the horns during operation of the sound emitter is reflected by the cylinder 13 before it leaves through the openings 9 between the open ends of the horns 8.

As will appear from FIG. 4, the width $B_S$ of the slot-shaped openings 9 approximately equals the width of the end openings 8 so that these openings 8 and 9, respectively, form a regular polygon, the "diameter" of which, i.e. the diametrical distance $B_D$ between two opposed openings 9, also is small in relation to the wavelength of the sound emitted.

It is pointed out that the invention is not restricted to the embodiments shown and described, and that the invention may be modified in several ways within the scope of protection claimed.

For example, the slot-shaped openings required for sound dispersion may be defined by other means than the peripheral edges of the horn openings, for example by means of baffles or the like. If such baffles provided with slots are mounted between the open ends 8 of the horns 4, such baffles may comprise, as an alternative, more than one slot between each pair of horns. In addition, the invention is applicable also to such sound sources where the section of the horn opening is not rectangular.

Finally, it should be mentioned that, in order to obtain a higher emitted effect, constructions of the type shown in FIGS. 1–3 or in FIG. 4 may be stacked upon each other along a common vertical axis.

We claim:

1. An omnidirectional sound emitter with separate sound sources (1, 2), each comprising a funnel-shaped horn (4) and each sound source (1, 2) having a sound-emitting end opening (8) through which the horn (4) is adapted to direct sound of a predetermined wavelength along an acoustic main axis of the horn (4), said horn emitter being adapted to emit acoustic energy through 360° in a predetermined plane (7), the sound-emitting end openings (8) of said horns (4) being directed toward a central portion of the sound emitter and spaced apart from one another, characterized in that the acoustic main axes of the horns (4) are parallel to said predetermined plane (7), and that separate slot-shaped openings (9), extending perpendicular to said predetermined plane (7) and having a width ($B_S$) parallel to the plane which is small in relationship to the wavelength of the sound emitted and being spaced a distance ($B_H$, $B_D$) from opposed slot-shaped openings (9) which is small in relation to the wavelength of the sound emitted, are so arranged between adjacent end openings (8) of the horns (4) that sound emitted from the end openings (8) of the horns (4) is caused to pass in a direction from the sound emitter through the separate slot-shaped openings (9), thereby to be dispersed in said predetermined plane (7) such that the sound representation by the sound emitter corresponds to sound representation from a line source perpendicular to said plane (7).

2. A sound emitter as claimed in claim 1, characterized in that longitudinal edges of said slot-shaped openings (9) are defined by peripheral edges (10) of the horns (4) at the horn end openings (8), said peripheral edges being essentially perpendicular to said plane (7).

3. A sound emitter as claimed in claim 2, characterized in that the end openings (8) of said horns (4) are essentially elongate in cross-section, the longitudinal axis of said cross-section being essentially perpendicular to said plane (7).

4. A sound emitter as claimed in claim 3, characterized in that the end openings (8) of the horns (4) are rectangular in cross-section.

5. A sound emitter as claimed in claim 1, characterized in that the sound emitter comprises two and only two such sound sources (1, 2) of which the horn end openings (8) have equal cross-section.

6. A sound emitter as claimed in claim 1, characterized in that a sound-reflecting body (13) is so arranged between the end openings (8) of the horns (4) and at a distance therefrom that a main part of the sound emitted by the horns (4) is reflected by the sound-reflecting body (13) before the sound leaves the slot-shaped openings (9).

7. A sound emitter as claimed in claim 6, characterized in that the acoustic main axes (6) of the horns (4) extend through a common point of intersection (12) in the said plane (7), that the sound reflecting body (13) is extended along and symmetrical about a line perpendicular to the said plane (7) and drawn through the point of intersection (12), and that the sound sources (1) and the horns (4) are symmetrically arranged in relation to said line.

8. A sound emitter as claimed in claim 7, characterized in that the sound-reflecting body (13) is cylindrical.

9. A sound emitter as claimed in claim 1, characterized in that the sound sources (1) operate in phase, such that a sound pressure at the horn end openings (8) of each sound source (1) is essentially the same at any moment.

* * * * *